US008655462B2

(12) United States Patent
Sanders

(10) Patent No.: US 8,655,462 B2
(45) Date of Patent: Feb. 18, 2014

(54) SYSTEM AND METHOD FOR ANALYZING GOLFER DRIVING ACCURACY

(76) Inventor: Peter Sanders, Stamford, CT (US)

( * ) Notice: Subject to any disclaimer, the term of this patent is extended or adjusted under 35 U.S.C. 154(b) by 430 days.

(21) Appl. No.: 12/718,639

(22) Filed: Mar. 5, 2010

(65) Prior Publication Data

US 2010/0228366 A1 Sep. 9, 2010

Related U.S. Application Data

(60) Provisional application No. 61/157,704, filed on Mar. 5, 2009.

(51) Int. Cl.
*G06F 19/00* (2011.01)

(52) U.S. Cl.
USPC ..... 700/91

(58) Field of Classification Search
None
See application file for complete search history.

(56) References Cited

U.S. PATENT DOCUMENTS

| | | | | | |
|---|---|---|---|---|---|
| 2,248,053 | A * | 7/1941 | Bales | 473/168 |
| 3,942,801 | A * | 3/1976 | Mintz | 473/159 |
| 4,113,260 | A * | 9/1978 | Sain | 273/245 |
| 4,127,273 | A * | 11/1978 | Bonvetti, III | 273/245 |
| 4,928,973 | A * | 5/1990 | Perry et al. | 473/409 |
| 5,319,548 | A * | 6/1994 | Germain | 700/92 |
| 5,419,561 | A * | 5/1995 | Weber | 473/409 |
| 5,588,652 | A * | 12/1996 | Lang | 473/168 |
| 5,681,108 | A * | 10/1997 | Miller | 700/92 |
| 5,779,566 | A * | 7/1998 | Wilens | 473/407 |
| 6,277,029 | B1 | 8/2001 | Hanley, Jr. | |
| 6,697,820 | B1 * | 2/2004 | Tarlie | 1/1 |
| 7,010,550 | B2 * | 3/2006 | Tarlie | 1/1 |
| 7,121,962 | B2 * | 10/2006 | Reeves | 473/407 |
| 7,766,737 | B2 * | 8/2010 | Sanders | 463/7 |
| 2002/0002083 | A1 * | 1/2002 | Hiatt | 473/170 |
| 2002/0019677 | A1 * | 2/2002 | Lee | 700/91 |
| 2003/0017890 | A1 * | 1/2003 | McDonald et al. | 473/407 |
| 2004/0162125 | A1 * | 8/2004 | Tarlie | 463/3 |
| 2004/0166965 | A1 * | 8/2004 | Hiatt | 473/411 |
| 2005/0026709 | A1 * | 2/2005 | Palmer et al. | 473/131 |
| 2005/0195934 | A1 * | 9/2005 | Heisler | 377/5 |
| 2007/0129178 | A1 * | 6/2007 | Reeves | 473/407 |
| 2008/0300699 | A1 * | 12/2008 | Smith, Jr. | 700/93 |
| 2009/0209358 | A1 * | 8/2009 | Niegowski | 473/223 |
| 2011/0070962 | A1 * | 3/2011 | Covino et al. | 473/174 |

(Continued)

OTHER PUBLICATIONS

"The 2002-2005 USGA Handicap System Online Manua—Section 1 Purpose and Requirements", 2005, United States Golf Association, available at <http://web.archive.org/web/20041205220304/www.usga.org/playing/handicaps/manual/section_01. html>.

(Continued)

*Primary Examiner* — Seng H Lim
(74) *Attorney, Agent, or Firm* — St. Onge Steward Johnston & Reene LLC

(57) ABSTRACT

In a method for analyzing the driving accuracy of a golfer, the number of fairway hits and the severity level of the number of fairway misses is adjusted based on a course rating and slope rating of the current and average courses in a database. An adjusted total stroke cost is applied to a driving accuracy handicap lookup table to produce a driving accuracy handicap. This handicap is graphically displayed to the user by itself, or compared to the driving accuracy handicap of users of the same or similar skill level. Finally, a hole-by-hole analysis can be graphically displayed to give a graphic representation of where the golfer needs improvement.

36 Claims, 8 Drawing Sheets

(56) References Cited

U.S. PATENT DOCUMENTS

| | | | | |
|---|---|---|---|---|
| 2011/0184538 | A1* | 7/2011 | Baker et al. | 700/92 |
| 2011/0230273 | A1* | 9/2011 | Niegowski et al. | 473/199 |
| 2011/0230274 | A1* | 9/2011 | Lafortune et al. | 473/217 |
| 2011/0230985 | A1* | 9/2011 | Niegowski et al. | 700/91 |
| 2011/0230986 | A1* | 9/2011 | Lafortune et al. | 700/93 |

OTHER PUBLICATIONS

"The 2002-2005 USGA Handicap System Online Manual—Section 10 USGA Handicap Formula", 2005, United States Golf Association, available at <http://web.archive.org/web/20041205220304/www.usga.org/playing/handicaps/manual/section_ 10.html>.

"The 2002-2005 USGA Handicap System Online Manual—Section 2 Definitions", 2005, United States Golf Association, available at <http://web.archive.org/web120041205220304 1www. usga.org/playing/hand icaps/manual/section_02. html>.

Oy, Suunto, "Suunto on How Not to Rely on Luck When Lowering Your Handicap", Aug. 2005, available at <http://media.suunto.com/media/suunto/manuals/en_US/golCguide_en_v3_m56577569830602841.pdf>.

Martin, Lawrence, "Why Are You Still a Hacker?", Apr. 19, 2000, Lakeside Press, available at <http://web.archive.org/web/20000419081735/www.lakesidepress.com/Golf/Step6-Shortgame.htm>.

* cited by examiner

Driving Accuracy Handicap Lookup Table

| Relative HDCP: | +7 | +6 | +5 | +4 | +3 | +2 | +1 | 0 | 1 | 2 | 3 | 4 |
|---|---|---|---|---|---|---|---|---|---|---|---|---|
| Strokes Lost: | 0.8 | 1 | 1.1 | 1.2 | 1.25 | 1.3 | 1.4 | 1.6 | 1.8 | 2 | 2.2 | 2.5 |
| | | | 1 | | | | | | | | | |
| Relative HDCP: | 5 | 6 | 7 | 8 | 9 | 10 | 11 | 12 | 13 | 14 | 15 | 16 |
| Strokes Lost: | 2.8 | 3 | 3.2 | 3.5 | 3.7 | 4 | 4.2 | 4.4 | 4.6 | 4.8 | 5 | 5.2 |
| | | | | | | | | | | | | |
| Relative HDCP: | 17 | 18 | 19 | 20 | 21 | 22 | 23 | 24 | 25 | 26 | 27 | 28 |
| Strokes Lost: | 5.5 | 5.7 | 5.9 | 6.2 | 6.4 | 6.5 | 6.6 | 6.7 | 6.9 | 7 | 7.2 | 7.4 |
| | | | | | | | | | | | | |
| Relative HDCP: | 29 | 30 | 31 | 32 | 33 | 34 | 35 | 36 | 37 | 38 | 39 | 40 |
| Strokes Lost: | 7.6 | 7.8 | 8 | 8.3 | 8.5 | 8.7 | 8.9 | 9.1 | 9.3 | 9.5 | 9.7 | 9.9 |

Figure 7

| Miss Result | Icon |
|---|---|
| Good Lie/opportunity:<br>One can easily hit the green or accomplish their next goal | 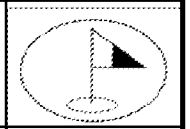 |
| Poor Lie/opportunity:<br>One can hit the green or accomplish their next goal but it will require a very good shot. | 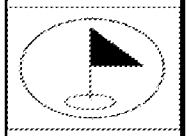 |
| No shot:<br>One must simply advance the ball to a better position. | 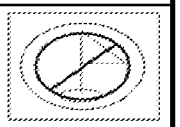 |
| Penalty:<br>A 1-shot penalty incurred. | 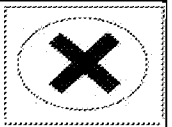 |
| Lost Ball or OB:<br>A Stroke + Distance penalty is incurred | 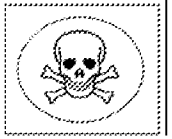 |

Figure 8

SYSTEM AND METHOD FOR ANALYZING GOLFER DRIVING ACCURACY

CROSS-REFERENCE TO RELATED APPLICATIONS

This application claims the benefit, under 35 U.S.C. 119 (e), of U.S. Provisional Patent Application No. 61/157,704, filed Mar. 5, 2009, the content of which is incorporated herein by reference.

FIELD OF THE INVENTION

The present invention relates generally to the game of golf, and more specifically, relates to methods, systems and software for analyzing the driving performance of a golfer.

BACKGROUND OF THE INVENTION

The statistical tool most commonly used to analyze driving performance is "Fairway hit" or "Fairway missed". A "Fairway hit" means that the shot played from the tee comes to rest within the closely mown area of the hole known as the fairway. A "Fairway missed" means that the shot played from the teeing ground comes to rest somewhere other than the closely mown area (fairway). Golfers will typically count the number of "Fairways hit" in a round or average the number of fairways hit in several rounds of golf. This number of fairways hit per round is the common method of measuring driving performance.

The "Fairways hit" driving performance statistic is incomplete as it only measures the relative frequency of success (Fairways hit) and does not provide any indication as to the character or severity of the "missed" fairways. For example, a golfer can hit 12 of 14 fairways (86%) in a given round but miss the other two drives in the worst of all possible outcomes—Out of Bounds—each miss incurring a stroke and distance penalty. Despite the two major errors, anyone looking at the golfer's driving statistics would see the high number of fairways hit and be lead to believe that the poor score had to be attributed to something other than a driving issue. In the same way, a golfer could hit only 4 of 14 fairways (29%), but the ten misses all result in reasonable or good positions. Again, the "Fairways hit" statistic would prove to be an inappropriate and misleading measure of the golfer's true driving performance.

What is desired, therefore, is a system and method of analyzing performance of golfers which provides an accurate indication of the golfer's driving accuracy and effectiveness. A system and method is needed that takes into account a golfer's performance on all drives and that specifically measures the relative severity of fairways missed and can further assign an accurate handicap to the golfer's driving performance as well as support this analysis with relevant comparative data.

SUMMARY OF THE INVENTION

Accordingly it is an object of the present invention to provide a system and method for analyzing the driving performance of golfers over multiple rounds of golf.

Another object of the present invention is to provide a system and method for analyzing the driving performance of golfers having the above characteristics and which calculates a driving accuracy handicap of the driving performance as a means of relating performance to that of other golfers and to the overall skill level of the golfer as indicated by the golfer's USGA Handicap.

A further object of the present invention is to provide a system and method for analyzing the driving performance of golfers having the above characteristics and which graphically displays the driving performance of the golfer.

Another object of the present invention is to provide a system and method for analyzing the driving performance of golfers having the above characteristics and which stores the data of all rounds of golf played in a recording device.

Still another object of the present invention is to provide a system and method for analyzing the driving performance of golfers having the above characteristics and which calculates a driving accuracy relative handicap.

These and other objects of the present invention are achieved, in accordance with one embodiment of the present invention, by provision of an apparatus for analyzing the driving performance of a golfer comprising: a data processing device having a program executing processing unit, a data storage device, and an output display device. A plurality of fairway hit data records, containing fairway hit data, and a plurality of fairway miss data records, containing fairway miss data, including at least some miss severity level, is stored on the data storage device. A program executes on the processing unit to calculate the driving accuracy of the golfer based on the number of fairway hits and the severity level of each fairway miss; and, displaying a graphic of the driving accuracy of the golfer on the display device.

In some embodiments a program executes on the processing device for displaying a graphic of the golfer's fairway misses and the severity level of each miss. In some embodiments a program executes on the processing device for comparing a data record of the golfer's driving accuracy with one or more data records of a driving accuracy of one or more additional golfers. In some embodiments a program executes on the processing device for comparing a data record of the golfer's driving accuracy with a data record of a driving accuracy of a median golfer of the golfer's skill level. In certain of these embodiments a program executes on the processing device for comparing the golfer's fairway miss data records with one or more data records of one or more additional golfers. In certain of these embodiments, the one or more data records of one or more additional golfers comprises fairway miss data records and fairway hit data records.

In some embodiments a program executes on the processing device for displaying a graphic comparison of the golfer's fairway miss data records with one or more data records of one or more additional golfers. In some embodiments a program executes on the processing device for displaying a graphic of the golfer's fairway misses and the severity of each miss on a hole-by-hole basis. In some embodiments a program executes on the processing device for displaying a graphic of the total strokes lost by the golfer on a hole-by-hole basis. In certain of these embodiments, the driving accuracy of the golfer is adjusted by a relative difficulty of a golf course to which the fairway hit data records and the fairway miss data records relate. In certain of these embodiments, the miss severity level data include data categories of: Good Lie, Poor Lie, No Shot, Penalty, and Lost Ball. In certain of these embodiments, the miss severity level data is a number corresponding to one of the severity level data categories.

In accordance with another embodiment of the present invention, a computer readable storage medium including a set of instruction executable by a process, the set of instructions operable to analyze the performance of a golfer by: receiving data regarding a golfer's number of fairway hits in at least one round of golf and storing such data as fairway hits data records; receiving data regarding a golfer's number of fairway misses and a severity level of the golfer's fairway misses in said at least one round of golf and storing such data as fairway misses data records and miss severity level data records; and calculating a driving accuracy using the fairway hits data records, fairway miss data records, and miss severity level data records.

In some embodiments the driving accuracy of the golfer is displayed on a display device. In some embodiments, a graphic display of the golfer's fairway misses and the severity of each miss is displayed on a display device. In certain embodiments, the driving accuracy includes calculating a driving accuracy relative handicap. In some embodiments the driving accuracy relative handicap is an accurate representation of the driving performance of the golfer compared to other golfers. In some embodiments, the driving accuracy relative handicap is based on all strokes lost to par from the missed fairways in a number of rounds selected for analysis. In some embodiments, the driving accuracy relative handicap is adjusted by a relative difficulty of the golf course in at least one round of golf played by the golfer. In certain embodiments, the severity levels include Good Lie, Poor Lie, No Shot, Penalty, and Lost Ball. In some embodiments, a number is assigned to each severity level. In certain embodiments, the graphical display of the golfer's misses and the severity level of each miss is graphically compared to a golfer of a same or similar level.

In accordance with a further embodiment of the present invention, a method for analyzing golfer performance comprising the steps of: receiving data regarding a golfer's number of fairway hits in at least one round of golf and storing such data as fairway hits data records; receiving data regarding a golfer's number of fairway misses and a severity level of the golfer's fairway misses in said at least one round of golf and storing such data as fairway misses data records and miss severity level data records; and executing a program for calculating a driving accuracy using the fairway hits data records, fairway miss data records, and miss severity level data records.

In some embodiments, the driving accuracy further includes calculating a driving accuracy relative handicap. In some embodiments, the driving accuracy relative handicap is a comparison of the driving performance of the golfer compared to other golfers as well as to the golfer's overall skill as represented by his USGA Handicap. In some embodiments, the driving accuracy relative handicap is based on all strokes lost to par from the missed fairways in a number of rounds selected for analysis. In some embodiments, the driving accuracy relative handicap is adjusted by a relative difficulty of the golf course in at least one round of golf played by the golfer. In certain embodiments, the severity levels include Good Lie, Poor Lie, No Shot, Penalty, and Lost Ball. In some embodiments, a number is assigned to each severity level. In certain embodiments, the golfer's fairway misses and the severity of each miss is graphically displayed. In some embodiments, the graphical display of the golfer's misses and the severity of each miss is graphically compared to a golfer of a same or similar skill level. In certain embodiments, the total strokes lost by the golfer is graphically displayed on a hole-by-hole basis.

In accordance with a further embodiment of the present invention, a method of calculating driving accuracy handicap of a golfer comprising the steps of: assigning a stroke cost to each missed fairway stroke; adding the stroke cost from each missed fairway stroke to produce a total stroke cost; dividing the total stroke cost by a total number of rounds to be analyzed to produce an average strokes lost per round; adjusting the average stroke lost per round by a relative difficulty of the course; and determining a driving accuracy handicap by looking up the driving accuracy handicap based on the adjusted average stroke lost per round.

In some embodiments, the adjustment of the relative difficulty of the course includes an average of a course rating and a slope rating.

The invention and its particular features and advantage will become more apparent from the following detailed description considered with reference to the accompanying drawings.

BRIEF DESCRIPTION OF THE DRAWINGS

FIG. 7 is an exemplary handicap lookup table.

FIG. 8 is a table of the definitions of the missed fairway results and the exemplary icons associated with and selected by the user to enter fairways missed results.

DETAILED DESCRIPTION OF THE INVENTION

Definitions

The following definitions are provided to explain the terms used in the specification and claims of this application.

Drive—All shots/strokes taken from the teeing ground on holes with par greater than 3.

Handicap—A "Handicap" is the term used by the United States Golf Association to indicate the number of strokes a player may subtract from his score for a game played at a specific set of tees at the course being played, in order to adjust the player's score to make it comparable to the score a "scratch" (zero-handicap) golfer would have.

Driving Accuracy Handicap—an implementation of the driving accuracy determination of the invention characterized as a handicap in order to relate the golfer's driving skill level to that of other golfers and to his/her overall skill level as represented by his/her USGA Handicap.

Fairway hit—A shot played from the teeing ground which comes to rest within the closely mown area of the hole known as the fairway.

Fairway miss (also referred to as Fairway missed)—The shot played from the teeing ground which comes to rest somewhere other than the closely mown fairway area.

Target handicap group—Each golfer using the system selects one of ten Target handicap groups against which each of his/her performance data will be directly compared. It is recommended that the group selected should be as close as possible, but just below, the golfer's current overall handicap.

Figure 1:
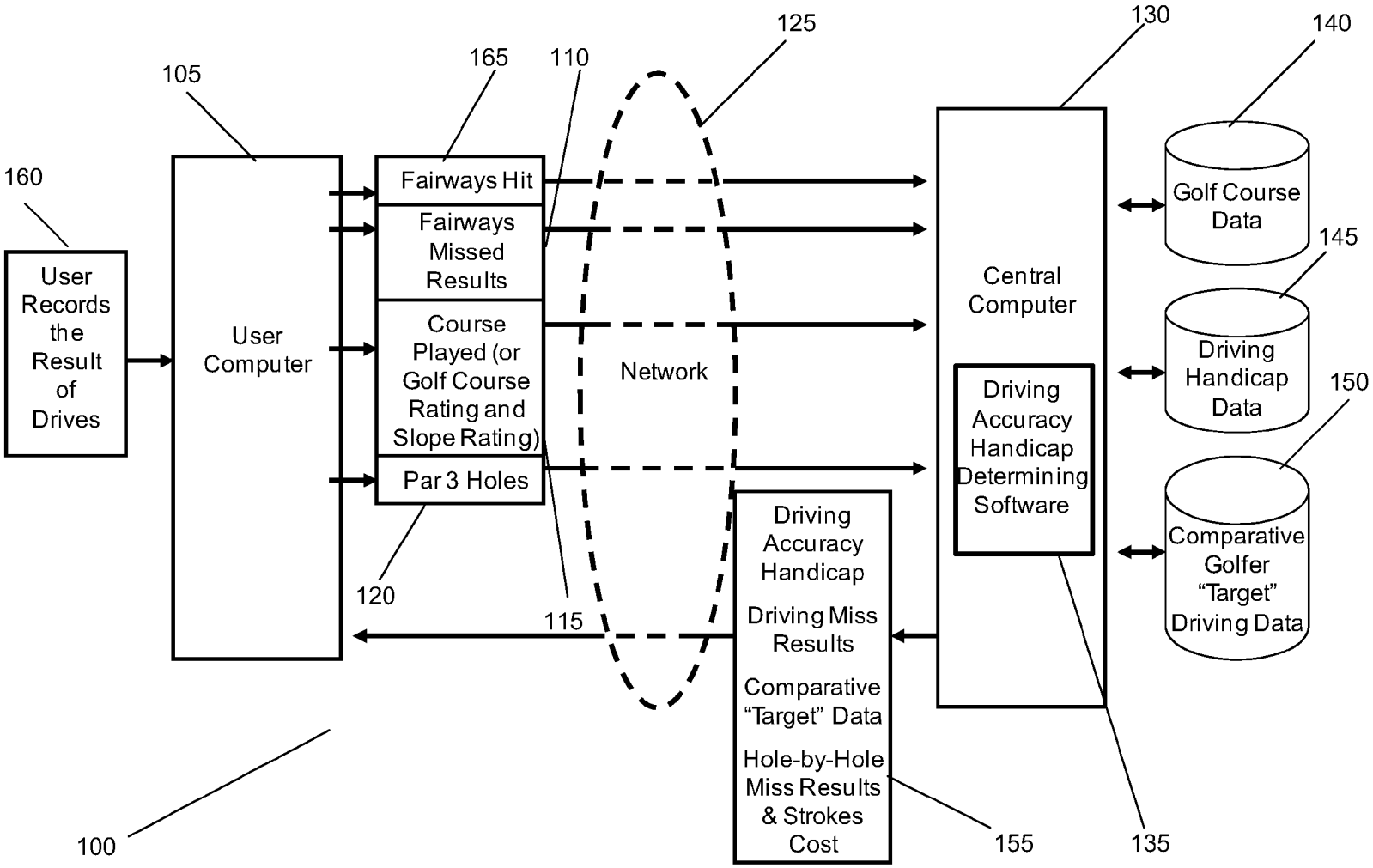
FIG. 1 is a schematic view illustrating a system for analyzing the driving performance of a golfer in accordance with an embodiment of the present invention

Referring first to FIG. 1, a system 100 for analyzing performance of a golfer in accordance with an embodiment of the present invention is shown. The user records the results of each drive at 160. The user can record the results for later input into the system 100, or the user can use a handheld system to record the results as the round of golf is played. The system 100 includes a user computer 105 and a central computer 130 having driving accuracy handicap determining software 135 executing thereon for performing calculations and various other functions as described in more detail below. Central computer 130 is in communication with golf course data storage 140 and driving handicap data storage 145, which may comprise, for example, databases or various other types of storage devices. The data stored on golf course data storage 140 and handicap data storage 145 is described below as necessary.

As shown in FIG. 1, user computer 105 and central computer 130 may comprise two separate computer systems in communication with one another via a network 125, such as the Internet, a local area network, a wide area network, a virtual private network, etc. When such is the case, user computer 105 may interface with central computer 130 via a web browser or the like, or user computer 105 may have a dedicated software application installed thereon. If desired, however, user computer 105 and central computer 130 may be combined into a single computer operated by a user, with handicap determining software 135 executing thereon. The computers 105 and 130 thus can be embodied in a myriad of possible apparatus, such as: a handheld apparatus that connects wirelessly to the central computer; or a handheld apparatus that connects to a user's computer with USB or other connectors and from there to the central computer; or a user's computer connecting to the central computer; or other standalone or networked devices.

In order to implement the inventive system and method of the present invention, the player or an appropriate authority keeps track of at least the following three pieces of data for at least one round of golf played: (i) the number of fairway hits results 165, (ii) the fairway missed results 110, which is defined in terms of a predefined severity level, and (iii) the number of par 3 holes 120. In recording the fairways missed results 110, the user is given a list predetermined severity levels which may include Good Lie, Poor Lie, No Shot, Penalty, and Lost Ball. In the exemplary embodiment, 5 levels of severity having the above labels are used. FIG. 8 discloses a table of suggested icons for use in a graphic interface for input of fairways missed results on a computer or handheld device. However, any number of severity levels with any label may be used, and is not limited to the number of severity levels and labels in the exemplary embodiment.

Figure 3:
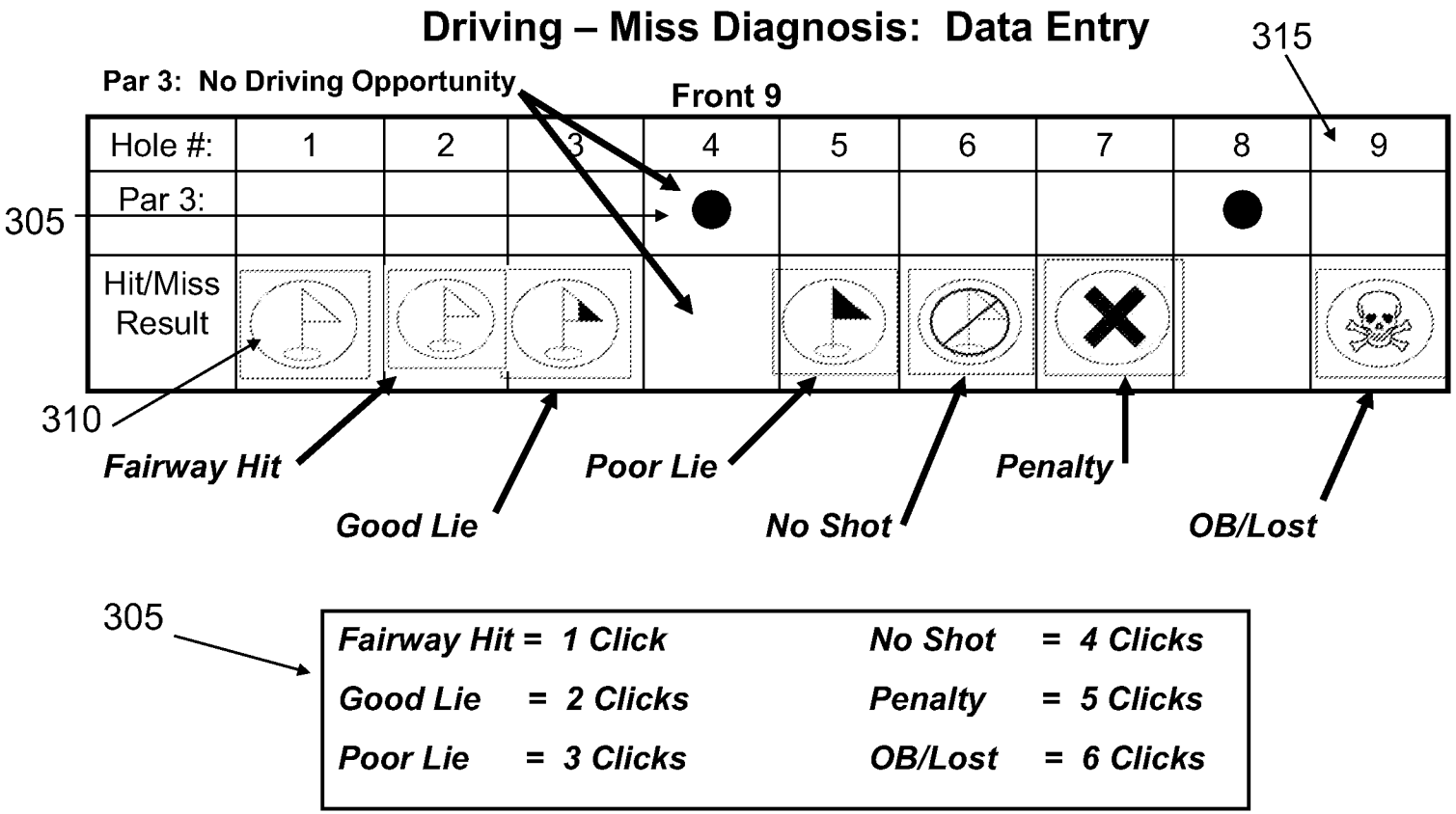
FIG. 3 is an exemplary screenshot of a graphical user interface for user data input of fairway hit, and fairways missed data.

The user of system 100 inputs the number of fairway hits results 165, the fairway missed results 110, and the par 3 holes 120 in the at least one round of golf using a graphical interface as shown in FIG. 3. The user also inputs an indication 115 of the golf course played during the at least one round of golf, which information is used by central computer 130 to retrieve the corresponding golf course rating and the slope rating for the course played from the golf course data storage 140, or alternatively, the indication 115 itself may include the golf course rating and the slope rating.

With this information, as well as information retrieved from golf course data storage 140 and driving handicap data storage 145, driving accuracy handicap determining software 135 executing on central computer 130 calculates the golfer's driving accuracy handicap, driving miss results, comparative "target" data, hole-by-hole miss results, and stroke cost 155 and transmits this information to user computer 105 for display to the user of system 100.

Figure 2:
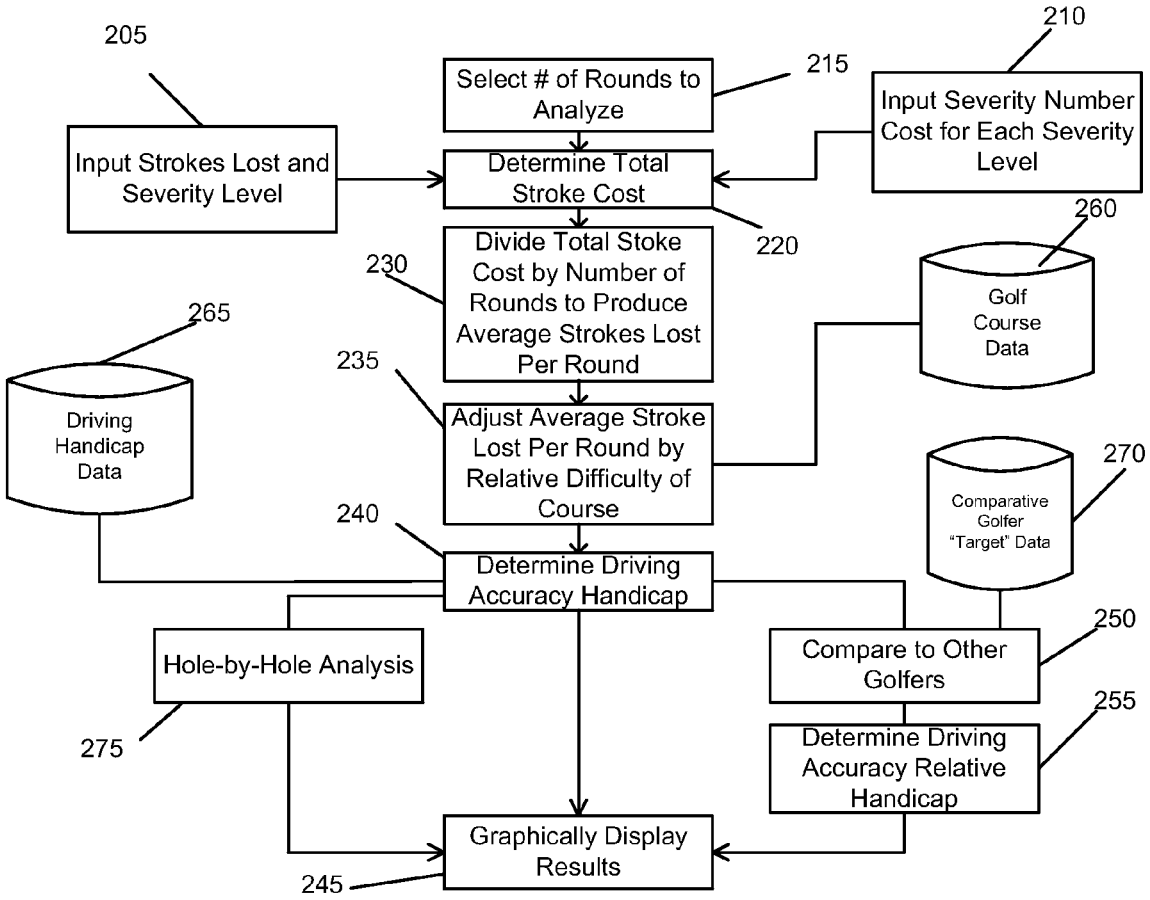
FIG. 2 is a schematic flow chart illustrating a method for analyzing the driving performance of a golfer in accordance with an embodiment of the present invention.

Referring now to FIG. 2, the various calculations and other operations performed by the driving accuracy handicap determining software 135 are shown. At step 205, the user inputs the number of fairways missed and the severity level of each fairway miss. This is done based on the user's determination of where the drive landed in relation to the fairway. As described above, the severity level may be Good Lie, Poor Lie, No Shot, Penalty, and Lost Ball, however, any number of severity level and labels may be used. The software automatically assigns a predetermined severity number cost to each severity level based on the assigned severity number cost for each severity level input in step 210. For example, Good lie may be assigned a severity number cost of 0.1 while No shot may be assigned a severity number cost of 0.85. It should be noted, however, that these numbers are for exemplary purposes only, and any numbers may be assigned to each severity level. Furthermore, the severity numbers can be changed or adapted at anytime to improve the algorithm. This is then added into the current user database that stores all previously inputted rounds of golf.

At step 215, the number of rounds to be analyzed is selected by the user. The user may select anywhere from one round to the total number of rounds that have been inputted by the user. At step 220, each stroke cost is added up for each missed fairway shot, from each round of golf selected for analysis, to produce a total stroke cost. At step 230, the total stroke cost is divided by the number of rounds selected for analysis to produce an average strokes lost per round. At step 235, the average strokes lost per round is adjusted by the relative difficulty of the golf course. The adjustment of the average strokes lost per round is done by an adjustment factor based on the actual course and slope rating for the round of golf played and the average course rating and slope rating from golf course data 260. A course rating difference is calculated by dividing the actual course rating by the average course rating. The slope rating difference is calculated by dividing the actual slope rating by the average slope rating. The course rating difference and the slope rating difference are averaged together to produce an adjustment factor. The average strokes lost per round is adjusted by the newly calculated adjustment factor to produce an adjusted strokes lost per round. At step 240, the adjusted strokes lost per round are used to determine the driving accuracy handicap by a lookup table (FIG. 7).

At step 240, the user has the option to display various types of results. The first option is the user can immediately graphically display the user's driving accuracy handicap and see the relative trend over time of their driving accuracy handicap. The user can also compare their driving accuracy handicap to other golfers of the same or similar skill level at step 250. To do this, the system retrieves the target golfer data from database 270 which may be stored on user computer 105, central computer 130, or in any other remote location. The user's driving accuracy handicap is compared to other golfers to produce a driving accuracy relative handicap 255, which is graphically displayed to the user. The user can also generate a hole-by-hole analysis 275 of the fairway misses and strokes lost to par to graphically display where the user needs improvement. While the above example gives three options for displaying the calculated driving accuracy of the handicap, the system and method can perform any number of calculations, and can display the data in many different ways, not limited to the above three examples.

The following example provides results of calculations in accordance with the above-described method, system and computer software of the invention.

Example

This example supposes the following pieces of information. In a single round of golf, a golfer had 9 fairway hits and 5 fairway misses and 4 par 3 holes. Of the fairway misses, three of them would fall into the severity level of Good Lie, one of them would fall into the severity level of Bad Lie, and one of them would fall into the severity level of No Shot. The stroke cost for Good Lie is 0.1, the stroke cost for Bad Lie is 0.3, and the stroke lost for No Shot is 0.85. The Actual Course rating is 69.5, the actual slope rating is 121, the average course rating is 71.5, and the average slope rating is 130. The user has further only selected this round of golf to be analyzed.

The total strokes lost from fairway misses is added up and divided by the number of rounds selected for analysis. In the present example, the total stroke cost is 0.1+0.1+0.1+0.3+0.85, which equals 1.45. This is divided by 1, since only a single round was selected for analysis. The adjustment factor is determined by dividing the actual course rating by the average course rating, dividing the actual slope rating by the average slope rating, and averaging the two numbers together. In the present example, the actual course rating of 69.5 is divided by the average course rating of 71.5 which equals 0.97. The actual slope rating of 121 is divided by the average slope rating of 130 which equals 0.93. The average of these two numbers produces an adjustment factor of 0.95. This means, that the current course is 5% less difficult than the average course in the database, and therefore the total stroke cost should be increased by 5%. The original total stroke cost was 1.45, so the new total stroke cost would be 1.53. This adjusted total stroke cost is then used in the driving accuracy handicap lookup table of FIG. 7 to determine the driving accuracy handicap.

Referring now to FIG. 3, an exemplary screenshot of the user input interface is shown. For each hole number 315, the user enters whether the fairway was hit, whether the hole is a par 3, or whether the fairway was missed. To select whether the user hit or missed the fairway, the user clicks the hit or miss result area 310. A single click denotes that the user hit the fairway. Subsequent clicks denote a Good Lie, Poor Lie, No Shot, Penalty, or Lost Ball. If the hole played was a par 3, then the user clicks box 305 to denote that the hole is a par 3, and the hit or miss result area becomes blank, not allowing the area to be clicked. It should be noted, that while a click system is used to input fairway hit, fairway miss, and severity level, and a check box is used to denote a par 3, any input method can be used to denote the outcome of the hole.

Figure 4:
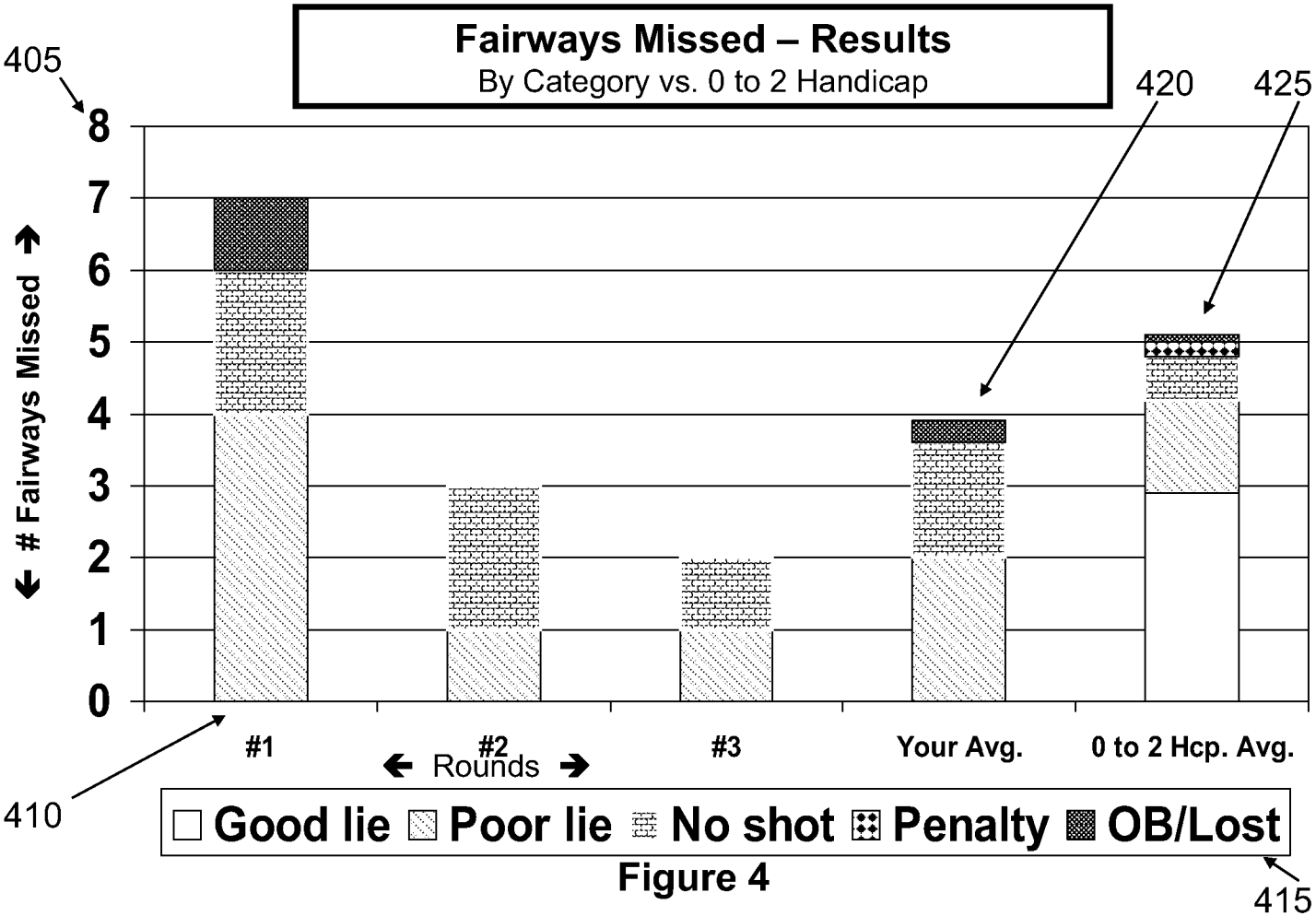
FIG. 4 is an exemplary graphical representation of fairways missed results.

Referring now to FIG. 4, an exemplary graphical representation of missed fairway results is shown. After a user has entered in the information from FIG. 3, the user can select to have a graphical representation of the fairway missed results shown. The user selects the number of rounds for analysis, and a graphical display of each round, shown separately at 410, is shown. The highest number of missed fairways from the rounds selected corresponds to the Y axis of the graph at 405. The user is also graphically displayed the average fairway missed results 420, and the average from golfer's of a similar handicap 425. Each round, the average, and the handicap average have different colored boxes stacked on top of each other to denote whether the missed fairway was a Good Lie, a Poor Lie, No Shot, Penalty, or Lost Ball. A legend 415 is placed at the bottom so the user can easily determine which color corresponds to which severity level. It should be noted, while the above example uses bar graph to graphically display the fairway missed results, any known graphical method may be used to display these results.

Figure 5:
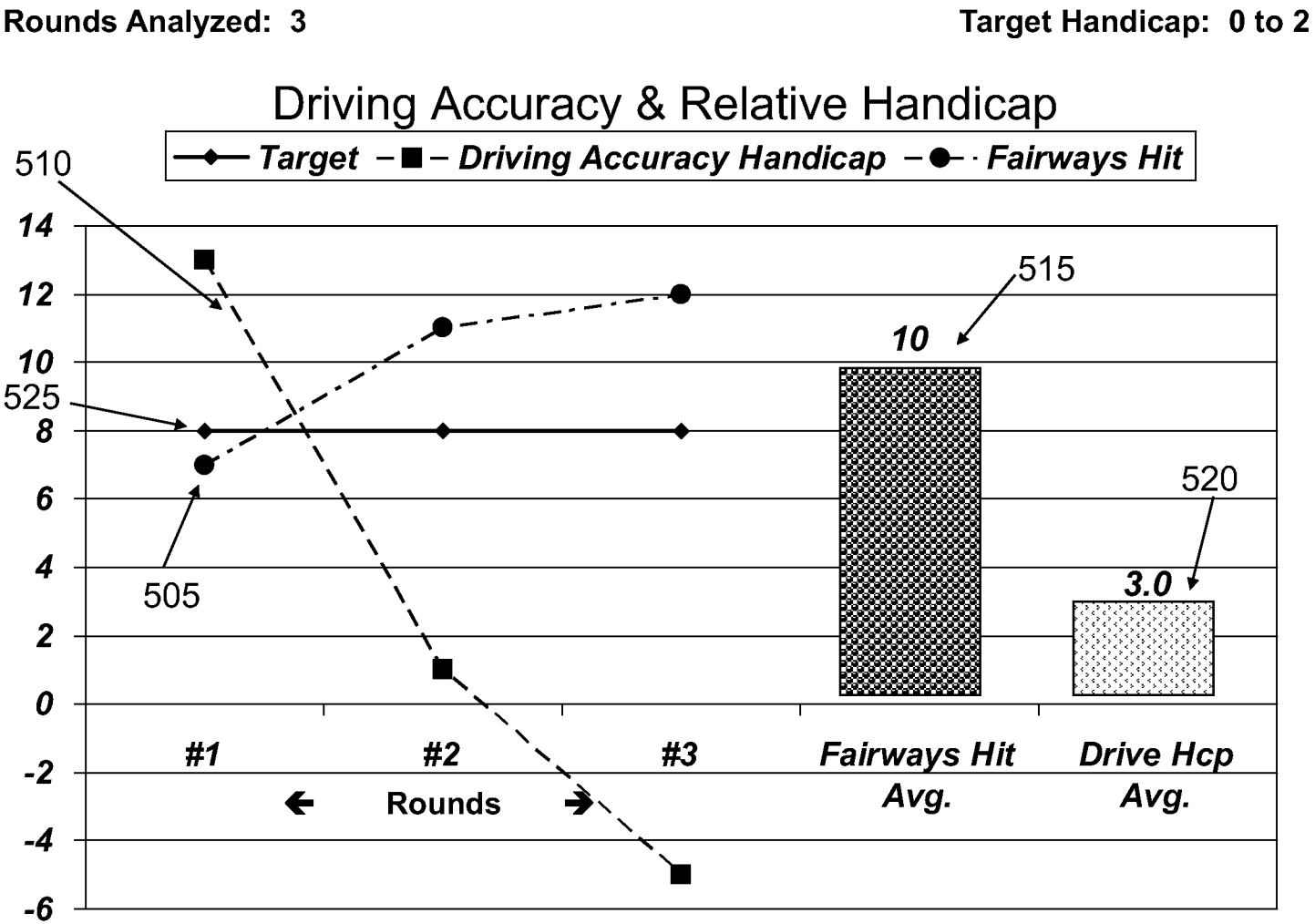
FIG. 5 is an exemplary graphical representation of a driving accuracy relative handicap.

Referring now to FIG. 5, an exemplary graphical representation of a driving accuracy relative handicap is shown. After the user has input the information for the round of golf, and has selected the number of rounds to analyze, the user can display their driving accuracy, and the relative handicap driving accuracy. The user is shown a graph with a first line 505 which represents the number of fairway hits in the number of rounds selected for analysis. This is displayed as an average bar graph 515. Line 525 represents the average number of fairway hits for the player's target handicap group. Line 510 represents the Driving Accuracy Handicap for each of the rounds of golf selected for analysis as calculated by the invention, with a corresponding average at bar graph 520. It should be noted, while the above example uses a line graph and a bar graph to graphically display the driving accuracy and relative handicap, any known graphical method may be used to display these results.

Figure 6:
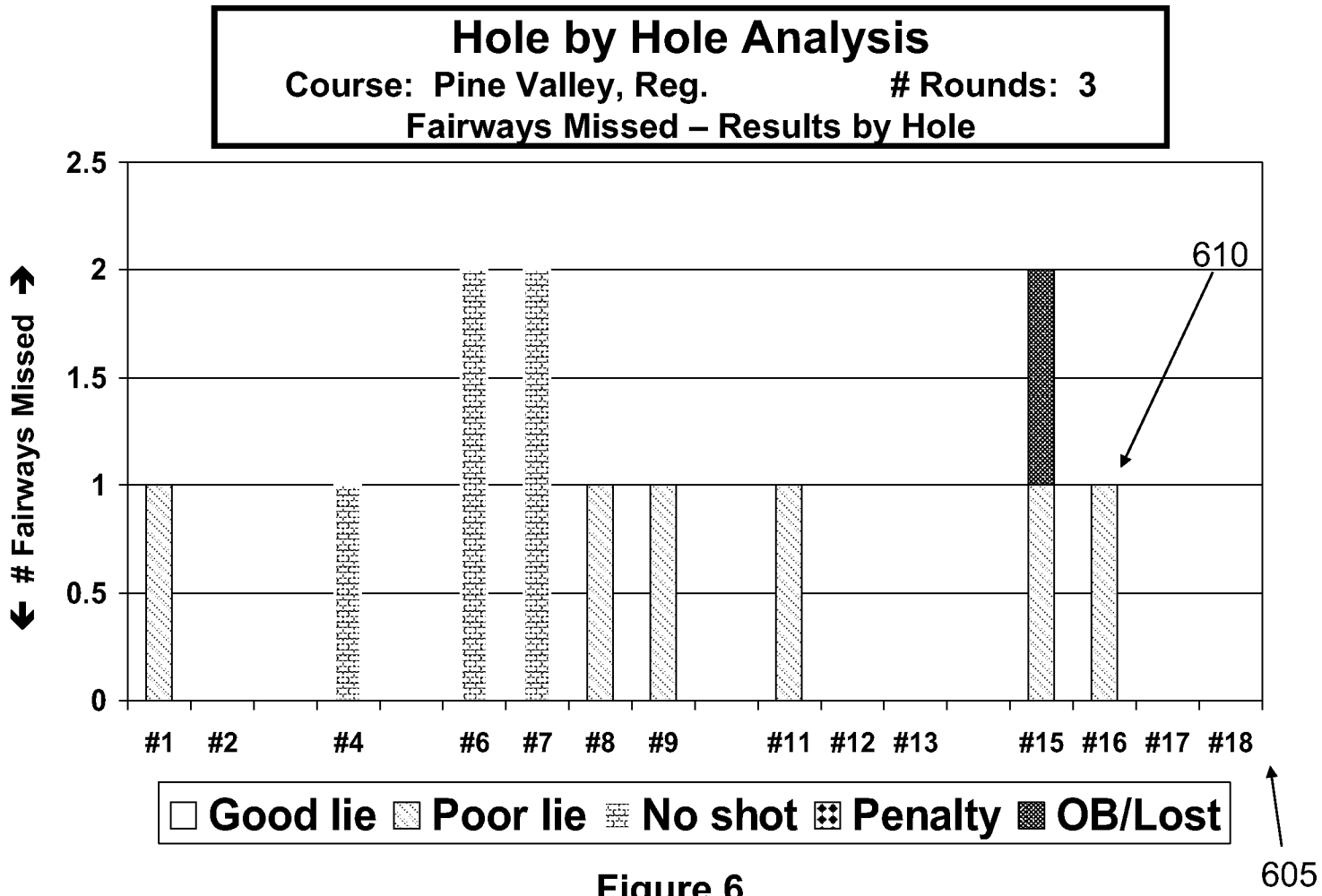
FIG. 6 is an exemplary graphical representation of fairways missed on a hole-by-hole analysis.

Referring now to FIG. 6, an exemplary graphical representation of fairways missed on a hole-by-hole analysis is shown. Each hole 605 has the results from each round of golf, selected for analysis, displayed on it at 610. The graph is color coded similar to the fairway missed results above to allow for ease of use. The user is able to see, at 610, the results of each hole from each round of golf, with the severity level numbers added together to show which holes the player has the most trouble with. The user can then see which holes to focus on to improve their driving accuracy.

FIG. 7 is an exemplary Lookup Table providing a correlation between the Strokes Lost and Driving Accuracy Handicap.

The present invention, therefore, provides a system, method, and software for determining the driving accuracy of a golfer in any number of rounds selected for analysis, which takes into account the severity level of the missed fairway shots, the course rating, and the slope rating.

Although the invention has been described with reference to a particular arrangement of parts, features and the like, these are not intended to exhaust all possible arrangements or features, and indeed many other modifications and variations will be ascertainable to those of skill in the art.

What is claimed is:

1. Apparatus for analyzing driving performance of a golfer, comprising:

a data processing device having a program executing processing unit, a data storage device, and an output display device;

a plurality of fairway hit data records, containing fairway hit data of a golfer, stored in said data storage device;

a plurality of fairway miss data records stored in said data storage device, containing fairway miss data of the golfer and data on a fairway miss severity level representing an estimated stroke cost of each fairway miss, wherein the estimated stroke cost of each fairway miss differs from other estimated stroke costs of other fairway misses according to a difference in fairway miss severity level; and programs executing on said data processing device for:

calculating a driving accuracy of the golfer based on the number of fairway hits and the severity level of each fairway miss; and displaying a graphic of the driving accuracy of the golfer on the output display device.

2. The apparatus of claim 1, further comprising programs executing on said data processing device for displaying a graphic of the golfer's fairway misses and the severity of each miss.

3. The apparatus of claim 1, further comprising programs executing on said data processing device for comparing a data record of the golfer's driving accuracy with one or more data records of a driving accuracy of one or more additional golfers.

4. The apparatus of claim 1, further comprising programs executing on said data processing device for comparing a data record of the golfer's driving accuracy with a data record of a driving accuracy of a median golfer of the golfer's skill level.

5. The apparatus of claim 1, further comprising programs executing on said data processing device for comparing the golfer's fairway miss data records with one or more data records of one or more additional golfers.

6. The apparatus of claim 4, wherein said one or more data records of one or more additional golfers comprise fairway miss data records and fairway hit data records.

7. The apparatus of claim 4, further comprising programs executing on said data processing device for displaying a graphic comparison of the golfer's fairway miss data records with one or more data records of one or more additional golfers.

8. The apparatus of claim 2, further comprising programs executing on said data processing device for displaying a graphic of the golfer's fairway misses and the severity of each miss on a hole-by-hole basis.

9. The apparatus of claim 7, further comprising programs executing on said data processing device for displaying a graphic of the total strokes lost by the golfer on a hole-by-hole basis.

10. The apparatus of claim 1, wherein the driving accuracy of the golfer is adjusted by a relative difficulty of a golf course to which the fairway hit data records and the fairway miss data records relate.

11. The apparatus of claim 1, wherein the fairway miss severity levels include: Good Lie, Poor Lie, No Shot, Penalty, and Lost Ball.

12. The apparatus of claim 11, wherein the fairway miss severity level data is a number corresponding to one of the severity levels.

13. A computer readable storage medium including a set of instructions executable by a processor, the set of instructions operable to analyze the driving performance of a golfer by:

receiving data regarding a golfer's number of fairway hits in at least one round of golf and storing such data as fairway hits data records;

receiving data regarding a golfer's number of fairway misses and a severity level of the golfer's fairway misses, representing an estimated stroke cost of each fairway miss wherein the estimated stroke cost of each fairway miss differs from other estimated stroke costs of other fairway misses according to a difference in fairway miss severity level, in said at least one round of golf and storing such data as fairway misses data records and miss severity level data records;

calculating a driving accuracy using the fairway hits data records, fairway miss data records, and miss severity level data records.

14. The computer readable storage medium of claim 13, further comprising instructions operable to display the driving accuracy of the golfer on an output display device.

15. The computer readable storage medium of claim 13, further comprising instructions operable to display a graphic of the golfer's fairway misses and the severity of each miss.

16. The computer readable storage medium of claim 13, wherein the calculating of the driving accuracy further includes calculating a driving accuracy relative handicap.

17. The computer readable storage medium of claim 16, wherein the driving accuracy relative handicap is an accurate representation of the driving performance of the golfer compared to other golfers.

18. The computer readable storage medium of claim 16, wherein the driving accuracy relative handicap is based on all strokes lost to par from the missed fairways in a number of rounds selected for analysis.

19. The computer readable storage medium of claim 18, wherein the driving accuracy relative handicap is adjusted by a relative difficulty of the course in at least one round of golf played by the golfer.

20. The computer readable storage medium of claim 13, wherein the severity levels include Good Lie, Poor Lie, No Shot, Penalty, and Lost Ball.

21. The computer readable storage medium of claim 20, wherein a number is assigned to each severity level.

22. The computer readable storage medium of claim 15, wherein the graphical display of the golfer's misses and the severity of each miss is graphically compared to a golfer of a same or similar skill level.

23. A method of analyzing the driving performance of a golfer comprising the steps of:

receiving data regarding a golfer's number of fairway hits in at least one round of golf and storing such data as fairway hits data records;

receiving data regarding a golfer's number of fairway misses and a severity level of the golfer's fairway misses, representing an estimated stroke cost of each fairway miss wherein the estimated stroke cost of each fairway miss differs from other estimated stroke costs of other fairway misses according to a difference in fairway miss severity level, in said at least one round of golf and storing such data as fairway misses data records and miss severity level data records;

calculating, via software executing on a computer, a driving accuracy using the fairway hits data records, fairway miss data records, and miss severity level data records.

24. The method of claim 23, wherein the calculating of the driving accuracy further includes calculating a driving accuracy relative handicap.

25. The method of claim 24, wherein the driving accuracy relative handicap is a comparison of the driving performance of the golfer compared to other golfers.

26. The method of claim 24, wherein the driving accuracy relative handicap is based on all strokes lost to par from the missed fairways in a number of rounds selected for analysis.

27. The method of claim 26, wherein the driving accuracy relative handicap is adjusted by a relative difficulty of the at least one round of golf played by the golfer.

28. The method of claim 23, wherein the severity levels include Good Lie, Poor Lie, No Shot, Penalty, and Lost Ball.

29. The method of claim 28, wherein a number is assigned to each severity level.

30. The method of claim 23, further including graphically displaying the golfer's fairway misses and the severity of each miss.

31. The method of claim 30, wherein the graphical display of the golfer's misses and the severity of each miss is graphically compared to a golfer of a same or similar skill level.

32. The method of claim 26, wherein the total strokes lost by the golfer is graphically displayed on a hole-by-hole basis.

33. A method of calculating a driving accuracy handicap of a golfer comprising the steps of:

assigning an estimated stroke cost to each missed fairway stroke wherein the estimated stroke cost assigned to each missed fairway stroke differs from estimated stroke costs assigned to other fairway misses according to a difference in fairway miss severity level;

adding, via software executing on a computer, the stroke cost from each missed fairway stroke to produce a total stroke cost;

dividing, via software executing on a computer, the total stroke cost by a total number of rounds to be analyzed to produce an average strokes lost per round;

adjusting the average stroke lost per round by a relative difficulty of the course; and determining a driving accuracy handicap by looking up the driving accuracy handicap based on the adjusted average stroke lost per round.

34. The method of claim 33, wherein the relative difficulty of the course includes an average of a course rating and a slope rating.

35. A method for analyzing performance of a golfer comprising the steps of:

determining a number of fairways hit and missed in regulation by the golfer during at least one round of golf;

determining a severity level of each fairway miss based on an estimated stroke cost of each fairway miss wherein each fairway miss severity level represents a different estimated stroke cost;

determining, via software executing on a computer, one or more of the following:

(a) calculating a driving accuracy relative handicap based on the number of fairway hits and the severity level of each fairway miss;

(b) graphically displaying the golfer's fairway misses and their severity level;

(c) graphically displaying the golfer's fairway misses and their severity level with comparison to an average of fairway misses and their severity for golfers in the same or similar skill level as the golfer determined by a database of fairway misses and their severity level;

(d) graphically displaying the golfer's fairway misses and their severity level on a hole by hole basis;

(e) graphically displaying the golfer's total strokes lost by hole on a hole by hole basis.

36. A system for analyzing performance of a golfer comprising:

a computer;

software executing on said computer for receiving data input regarding a number of fairways hit and missed by the golfer during at least one round of golf and a severity level of each fairway miss based on an estimated stroke cost of each fairway miss wherein each fairway miss severity level represents a different estimated stroke cost;

software executing on said computer for determining one or more of the following:

(a) calculating a driving accuracy relative handicap based on the number of fairway hits and the severity level of each fairway miss;

(b) graphically displaying the golfer's fairway misses and their severity level;

(c) graphically displaying the golfer's fairway misses and their severity level with comparison to an average of fairway misses and their severity level for golfers in the same or similar skill level as the golfer;

(d) graphically displaying the golfer's fairway misses and their severity level on a hole by hole basis;

(e) graphically displaying the golfer's total strokes lost by hole on a hole by hole basis.

* * * * *